United States Patent [19]

Smith

[11] 4,359,375

[45] Nov. 16, 1982

[54] ANODE ASSEMBLY FOR ELECTROFORMING RECORD MATRIXES

[75] Inventor: Kobert R. Smith, Carmel Valley, Calif.

[73] Assignee: RCA Corporation, New York, N.Y.

[21] Appl. No.: 328,833

[22] Filed: Dec. 9, 1981

[51] Int. Cl.[3] ..... C25D 17/00; C25D 21/10

[52] U.S. Cl. ..... 204/212; 204/275; 204/DIG. 7

[58] Field of Search ..... 204/212, 216, 275, DIG. 7

[56] References Cited

U.S. PATENT DOCUMENTS 3,186,932 6/1965 Gelfand ..... 204/216
3,809,642 5/1974 Bond ..... 204/DIG. 7
3,954,569 5/1976 Vanderveer ..... 204/DIG. 7
4,304,641 12/1981 Grandia ..... 204/DIG. 7

*Primary Examiner*—T. Tufariello
*Attorney, Agent, or Firm*—Birgit E. Morris; Edward J. Sites

[57] ABSTRACT

An anode assembly is provided for use in the electroforming of record matrixes. The anode assembly is comprised of a pair of spaced apart anode baskets for holding a supply of the metal to be electrodeposited, an electrolyte distribution manifold positioned between the baskets and a pair of anode shields positioned in front of each of the anode baskets for focusing the electroforming forces from the anode.

6 Claims, 2 Drawing Figures

ANODE ASSEMBLY FOR ELECTROFORMING RECORD MATRIXES

This invention is concerned with an anode assembly for use in apparatus employed for electroforming replicas on record matrixes.

BACKGROUND OF THE INVENTION

In the manufacture of molded records, such as audio records and the more recently developed video records, a plastic composition is molded between a pair of metal plates referred to as stampers which have the information desired to be molded into the record defined in the surface thereof. The stampers are the end product of a multi-step replication process. The initial step in the replication process is to record the information desired to be molded into the record on a magnetic tape. The recorded magnetic tape is then used to control a cutting tool which cuts an information track in a flat, disc-shaped member referred to as a recording substrate. The resulting recording substrate has the surface relief pattern desired to be molded into the final record and could conceivably be played back on suitable apparatus to reproduce the recorded information. However, it is not practical to use the recorded substrate for playback because of, among other things, the extremely high cost involved in cutting the recording into the recording substrate. The recording substrate is, however, used in the replication procedure which ultimately results in the production of the stampers.

The next step in the replication process is to electroform a metal replica on the recorded surface of the recording substrate. The recording substrate is mounted and rotated in the cathode position of an electroforming apparatus while a supply of the metal to be electroformed on the substrate, typically nickel, is provided at the anode of the electroplating apparatus. The electroforming of the replica on the recording substrate is conducted by electroforming methods well known in the art. After a sufficient amount of metal has been electrodeposited on the recording substrate, the resulting electroformed part is then separated from the recording substrate. The resulting electroformed part is referred to in the art as a master, and is a negative replica of the starting recording substrate.

The master is in turn duplicated a number of times until the resulting replicas start to show significant loss of fidelity to the master on which they are electroformed. The electroformed replicas formed on the master are referred to in the art as molds or mothers. The molds or mothers are positive copies of the original recorded substrate.

Each of the molds or mothers is then, in turn, also replicated several times in a similar electroforming process to produce a third series of electroformed metal parts referred to as stampers. The stampers are negative replicas of the original recording substrate. As noted above, it is the stampers which are ultimately used as the molding plates to press molded records. The record molded on the stampers should be an accurate replica of the original recorded substrate, and on playback should result in a high fidelity reproduction of the information initially recorded on the recording substrate.

Many problems are, however, encountered in the electroforming process. One of the major problems encountered is that often the metal is electrodeposited on the part to be duplicated such as the recording substrate, the master or the mold (hereinafter referred to collectively as matrixes), in a non-uniformly thick layer so that the electroformed part has varying thicknesses across its diameter. The non-uniform deposition causes problems in the further replication of the master and molds, and is especially troublesome with regard to the stampers. The nonuniformity in thickness can cause defects in the molded records and also substantially reduce the useful life of the stampers.

A further problem encountered in the electroforming process is that often foreign particles, or even excessively large particles of the metal desired to be plated onto the replicas, are attracted to the surface of the matrix being duplicated. If these particles are not removed from the surface before any substantial amount of plating occurs, the particles can cause surface and internal defects in the resulting replicated part.

What would be highly advantageous would be an apparatus which would improve the uniformity of the plating and also which would prevent or substantially reduce defects caused by the presence of foreign materials or large pieces of metal on the surface of the matrixes during electroforming.

BRIEF SUMMARY OF THE INVENTION

It has been found in accordance with the present invention that the uniformity and overall quality of electroformed replicas formed on record matrixes can be substantially improved using an anode assembly which is comprised in combination of a bifurcated holder for supplying metal for the electroforming, an electrolyte distribution manifold positioned between the bifurcated parts of the holder and a pair of anode shields positioned in front of each of the holders for focusing the electroforming forces toward the cathode of the electroforming apparatus.

DETAILED DESCRIPTION OF THE INVENTION

Figure 1:
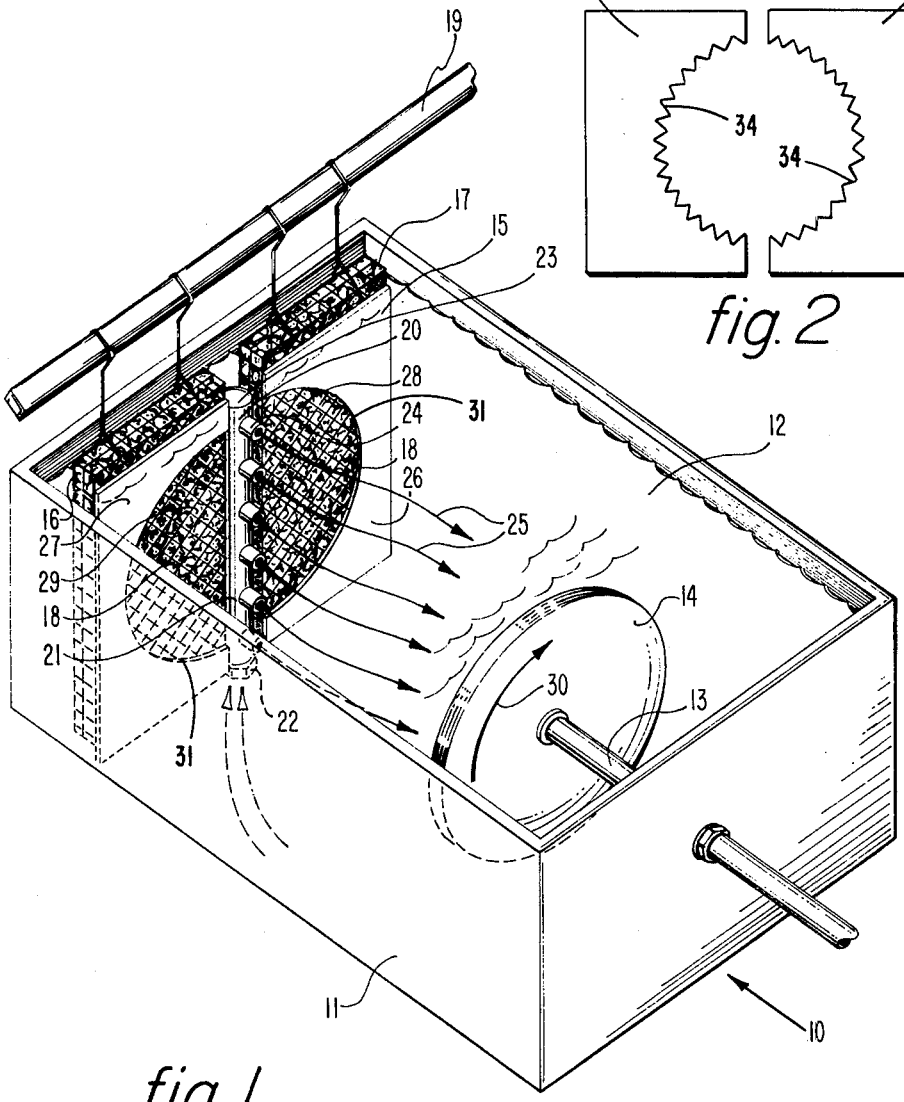
FIG. 1 is a schematic pictorial illustration shown in three dimensions of an electroforming apparatus having the anode means of this invention.

In FIG. 1 there is illustrated in somewhat schematic form an electroforming apparatus 10. The electroforming apparatus 10 includes a tank 11 for holding electrolyte 12 and a cathode 13 having a rotatable cathode head 14 mounted at one end of the tank and the anode means 15 of this invention mounted at the opposite end of the tank 11.

The anode assembly 15 has a bifurcated anode supply means comprised of a pair of anode baskets 16, 17. The anode baskets 16, 17 can be made of various materials, such as certain plastic materials which are resistant to the chemicals and electrical conditions encountered in the electroforming process. The baskets 16, 17 are, however, preferably made of titanium in that titanium is not adversely affected by the chemical and electrical conditions encountered in the electroforming process. The baskets 16, 17, as illustrated in FIG. 1, are made in an open mesh-like configuration, but it should be appreciated that other configurations can be used which allow electrolyte 12 to flow through the baskets 16, 17 during electroforming.

The baskets 16, 17 are used to hold a supply of the metal desired to be electrodeposited on the matrix. The metal generally is supplied in the form of small pieces or buttons 18. The metal pieces or buttons 18 are inserted into the baskets 16, 17 as required during the electroforming process. The baskets 16, 17 are hung from the anode electrical supply 19 of the electroforming apparatus 10. As illustrated in FIG. 1, the pair of anode baskets 16, 17 are suspended into the electrolyte 12 in the tank 11 and are slightly separated from each other by a predetermined distance.

Positioned between the anode baskets 16, 17 is an electrolyte discharge manifold 20. The manifold 20 consists of an upright conduit 21 which has an opening 22 at its lower end to admit filtered electrolyte 12 from a filter and circulating pump (not shown). The upper end 23 of the upright conduit 21 is sealed and capped. Located along the length of the upright conduit 21 there are a plurality of outlet nozzles 24. The nozzles 24 are in communication with the interior of the upright conduit 21 so that the electrolyte 12 will flow from the interior of the pipe through the nozzles 24 as indicated by the flow arrows 25. The nozzles 24 can be of fixed internal size, but preferably should be individually adjustable for modulating the rate of flow from each of the nozzles 24 as required in order to obtain optimum results with the electroforming apparatus 10.

Positioned in front of each of the anode baskets 16, 17 is an anode plating shield 26, 27. The plating shields 26, 27 are made of material which will not be adversely affected by the chemical or electrical conditions encountered during the electroforming process. The anode shields 26, 27 are placed in position adjacent to the surface of the anode baskets 16, 17 facing toward the cathode head 14. The anode masks 26, 27 have chordal open sections 28, 29, which expose a predetermined portion of the anode baskets 16, 17. The chordal sections 28, 29 are somewhat less than semicircular, but when taken together with the opening occupied by the manifold 20, the combined diameter of the openings is the same, slightly more, or slightly less than the diameter of the replica which is to be electroformed on the matrix (not shown) held by the cathode head 14. The anode shields 28, 29 are interchangeable with other similarly shaped anode shields which have either larger or smaller chordal sections as required in order to obtain uniform plating of the replica, as will be explained below.

Figure 2:
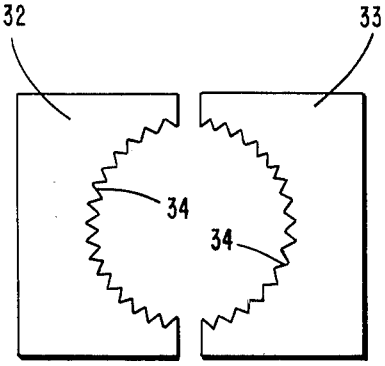
FIG. 2 is an alternate type of anode shield for use in the anode assembly of this invention.

The anode shields 28, 29 as illustrated in FIG. 1 have smooth edges 31 about the chordal sections 28, 29 as this is the optimum configuration when it is desired to have as uniform a plating as possible over the surface of the matrix. However, it is also possible to vary the edge configuration of the chordal sections to impart special effects to the deposited replicas. An especially advantageous alternate embodiment is illustrated in FIG. 2 wherein the anode shields 32, 33 have saw tooth edges 34 about the chordal sections 32, 33. The use of the saw tooth edge 34 results in a feathering of the plating at the edge of the replica which is highly advantageous for certain matrixing applications and also assists in the separation of the replicas from the matrixes.

In use, the initial step is to mount a matrix (not visible in FIG. 1) which has had the grooved surface thereof passivated. The cathode head 14 is immersed into the electrolyte 12, and rotated as indicated by the arrow 30. The electrolyte 12 is circulated through the tank 11. The electrolyte 12 is removed through an outlet (not shown) and then subjected to filtering and other treatments to remove impurities from the electrolyte, especially particulate materials. The treated electrolyte is then introduced into the tank 11 through the inlet manifold 20. The outlet nozzles 24 and the pressure of the electrolyte flowing through the nozzles 24 are controlled so the electrolyte will flow through the bath and flush the face of the cathode head 14 as it rotates in the electrolyte 12. The force of the flow of electrolyte from the manifold 20 over the surface of the matrix removes most of the foreign particles and the large bits of nickel particles from the surface of the matrix before thy are plated into the replica causing defects. The nozzles 24 of manifold 20, if adjustable, are balanced to correct any minor adverse unbalanced conditions encountered in the electroforming process, and thereby improve the quality and levels of the electroformed part formed on the matrix. The particles which are flushed from the surface of the matrix by the flow of electrolyte are eventually circulated to the drain and then removed from the system in the filtering sytems.

The anode baskets 16, 17 are recharged as required with a supply of the metal desired to be deposited on the matrix. The metal is generally supplied in the form of small buttons or particles 18.

The anode shields 26, 27 are installed on the surface of the anode baskets 16, 17. The exact diameter of the opening defined by the chordal sections can be varied by using different size anode masks 26, 27 having either larger or smaller chordal openings 28, 29 as noted above. The selection of the proper size anode shield is dependent on a number of interrelated factors, such as the total distance between cathode head 14 and the anode baskets 16, 17, the amount of current employed during the electroplating process, and the composition of the electrolyte used in the plating process. These and other interrelated factors determine the lines of electrical force created during the electroforming operation in the plating bath. It is desirable to have the lines of force focused onto the surface of the replica being electroformed. It is one of the primary functions of the anode shield to provide the focusing in the apparatus of the present invention. The anode shields 26, 27, in combination with control of the flow from the manifold 20, are used to control the rates of deposition and to help to deposit the metal in a uniformly thick layer of metal on the matrix.

It has been found that using the anode means of the present invention the uniformity of the deposition can be more easily and accurately controlled, and that defects caused by the presence of foreign particles and the like are substantially reduced.

I claim:

1. In an electroforming apparatus used for the formation of metal replicas on record matrixes wherein the apparatus includes a revolvable cathode head on which a matrix to be replicated is mounted, an anode assembly positioned in an opposing relationship to the revolvable cathode head and a circulatable supply of electrolyte, the improved anode assembly comprising in combination: a bifurcated holding means for receiving a supply of the metal to be electroformed, said holding means being comprised of first and second receptacles, said receptacles being positioned relative to each other in a vertical, side-by-side relationship, with a separation of a predetermined width between said receptacles; said anode assembly further including a manifold means for distributing the electrolyte circulated in said electroforming apparatus, said manifold means including an elongated conduit having an inlet port for receiving circulating electrolyte into the interior thereof and having a plurality of outlet nozzle means positioned along the length of the conduit which are in communication with the interior of the conduit, said manifold having a width of approximately that of said predetermined width and being positioned between the first and second receptacles with the outlet nozzle means directed towards the revolvable cathode head; said anode assembly further including first and second shield members positioned adjacent to the first and second receptacles, respectively, and being positioned between the revolvable cathode head and the first and second receptacles, said shield members covering the entire area of each of the receptacles except for a chordal-shaped section thereof such that the chordal-shaped section of the first and second shield members taken together with the width of the separation constitute a circular opening of a given diameter, said given diameter being of a size sufficient to focus the electroforming forces produced during electroforming from the anode assembly to the revolvable cathode head; whereby when a matrix is mounted on the revolvable cathode head and an electrolyte is circulated through the electroforming apparatus for electroforming a replica on the matrix, the electrolyte is directed toward and flows over the surface of the revolving matrix and the electroforming forces are simultaneously focused towards the matrix, thereby improving the quality of the replica electroformed thereon.

2. The apparatus according to claim 1 wherein the nozzles are adjustable to vary the rate of flow from each of the nozzles towards the revolvable cathode head.

3. The apparatus according to claim 1 wherein the diameter of the opening formed by the shields and the separation is larger than the diameter of the matrix to be replicated.

4. The apparatus according to claim 1 wherein the diameter of the opening defined by the first and second shield means and the separation is smaller than the diameter of the matrix to be replicated.

5. The apparatus according to claim 1 wherein the portion of the diameter defined by the first and second shield member has a smooth circular configuration.

6. The apparatus according to claim 1 wherein the portion of the diameter defined by the first and second shield member have a saw tooth configuration sufficient to cause a feathered edge depositon of metal on the matrix.

* * * * *